United States Patent [19]

Sanders

[11] 4,144,446

[45] Mar. 13, 1979

[54] BIORHYTHM CALCULATOR

[76] Inventor: Lincoln L. Sanders, 22204 Mariano St., Woodland Hills, Calif. 91367

[21] Appl. No.: 655,910

[22] Filed: Feb. 6, 1976

[51] Int. Cl.[2] ..... G06C 3/00

[52] U.S. Cl. ..... 235/85 FC; 235/89 R

[58] Field of Search ..... 235/78 R, 88 R, 88 RC, 235/85 R, 85 FC, 89 R

[56] References Cited

U.S. PATENT DOCUMENTS

| | | | |
|---|---|---|---|
| 2,650,764 | 9/1953 | Pirszel | 235/88 RC |
| 3,082,947 | 3/1963 | Livingston | 235/88 RC |
| 3,253,780 | 5/1966 | Stewart et al. | 235/78 |
| 3,964,674 | 6/1976 | Van der Gaast | 235/88 RC |

*Primary Examiner*—Robert K. Schaefer
*Assistant Examiner*—Vit W. Miska
*Attorney, Agent, or Firm*—Charles T. Silberberg

[57] ABSTRACT

A biorhythm calculator comprising at least two members, a rhythm scale member and a key scale member. The rhythm scale member has a major surface having a biorhythm cycle thereon, the cycle being identified by numbers of the days of the cycle, with the numbers being divided into at least three groups corresponding to high, low and critical periods of the cycle. The key scale member has a major surface parallel to the major surface of the rhythm scale member with such surface having figures indicating biorhythm positional relationship for the biorhythm cycle. The rhythm scale member and key scale member are moveable relative to one another so that the key scale figures can be compared to the periods of the cycle to determine which of these figures correspond to the specific periods of the cycle. Preferably, there are three rhythm scale members, each corresponding to a respective biorhythm cycle, and three key scale members, one for each respective rhythm scale member. The key scale members would preferably have designations for a plurality of persons corresponding to the key scale figures identified adjacent the figures so that the periods of the cycle can be compared to the designations to determine the periods of the cycles applicable to designated persons for a specific day. A compatibility percentage scale can also be provided on each rhythm scale member which indicates percentage of compatible difference between one day in the related biorhythm cycle to all other days of such cycle. The compatibility scale can be compared to the key scale designations to determine compatibility percentage for designated persons relative to a specific person.

11 Claims, 5 Drawing Figures

BIORHYTHM CALCULATOR

BACKGROUND OF THE INVENTION

This invention relates to biorhythm calculators, specifically to an apparatus for visually indicating high, low, and critical periods of the three biorhythm cycles for any specific day for a plurality of persons simultaneously, thereby visually presenting a comparative indication for the plurality of persons for the three biorhythm cycles, or for visually indicating the percentage of biorhythm compatibility of one individual to a plurality of persons for all three cycles simultaneously, or to indicate for one person the high, low, and critical periods of the three cycles for any given month.

It is basic biorhythm theory that people have an innate trio of separate biological rhythms, designated "emotional," "physical," and "intellectual." The theory holds that the three rhythms begin at the moment of birth and run in steady immutable cycles throughout one's life. At the moment of each person's birth, these cycles are permanently fixed in a position relative to those of each other human birth. Half of each cycle is composed of positive discharging days, the other half of negative recharging days. The real problem days, however, are those on which one or more of the three rhythms change from positive to negative or vice versa. The theorists call these critical days, full of potential danger, because the person is in a state of flux, unstable and according to the theory, more prone to errors, accidents, and physical setbacks. Double—and even worse —triple critical days, when all three rhythms change simultaneously, are considered even more serious.

The theory also postulates:

During the first half of the twenty-three day physical cycle, a person is more vigorous and his endurance is greater. During the second, or negative half, a person has less energy and tires more quickly.

During the first half of the twenty-eight day emotional cycle, a person is more cheerful and optimistic while during the second half he is more moody and negative.

During the first half of the thirty-three day intellectual cycle, a person thinks more clearly and remembers better. During the second half, thinking ability is lessened and it is more difficult to learn.

Devices have come on the market to calculate for any person the different periods of the biorhythm cycles. A very significant disadvantage of prior devices is that they are geared to an individual person so that a time consuming calculation is required for each specific person when a number of persons are to be considered. Further, as these prior devices are geared to only one person, compatibility of different people or groups of people cannot be compared without a plurality of these prior art devices and/or time consuming calculations for each person who's compatibility is to be considered.

SUMMARY OF THE INVENTION

It is, therefore, an object of the present invention to provide a simple, concise, inexpensive, accurate, and quick biorhythm calculator.

It is another object of the present invention to provide a biorhythm calculator where the periods of the biorhythm cycles for a plurality of persons for a specific day can be visually determined simultaneously.

It is yet another object of the present invention to provide a biorhythm calculator where biorhythm compatibility for the biorhythm cycles for a plurality of people can be visually determined relative to any given person simultaneously.

It is still another object of the present invention to provide a biorhythm calculator which can visually indicate for a given month and person, the periods of the biorhythm cycles.

Moreover, another object of the present invention is to provide a biorhythm calculator having slideable members with identified scales thereon to indicate the desired information when compared to one another.

Briefly, in accordance with the invention, there is provided a bio-rhythm calculator having a rhythm scale member and a key scale member. Each of the members have a major surface. The major surface of the rhythm scale member has a bio-rhythm cycle identified thereon. The cycle is identified by numbers of the days of the cycle with the numbers being provided into at least three identified groups corresponding to high, low, and critical periods of the cycle. The major surface of the key scale member is parallel to the major surface of the rhythm scale member and has figures indicating biorhythm positional relationship for the specific biorhythm cycle of the rhythm scale member. The rhythm scale member and key scale member are moveable relative to one another such that the key figures can be compared to the identified groups to indicate periods of a cycle corresponding to the key scale figures. Optimally, a compatibility scale is also provided on the major surface of the rhythm scale member which indicates percentage of compatible difference between one day in the cycle to the other days of the cycle. The key scale figures can be compared to the compatibility scale to indicate compatibility corresponding to the figures.

Other objects and advantages of the invention, will become apparent upon reading the following detailed description and upon reference to the drawings.

While the invention will be described in connection with the preferred embodiment, it will be understood that it is not intended to limit the invention to that embodiment. On the contrary, it is intended to cover all alternatives, modifications and equivalants that may be included within the spirit and scope of the invention as defined by the appended claims.

DETAILED DESCRIPTION OF THE INVENTION

Figure 1:
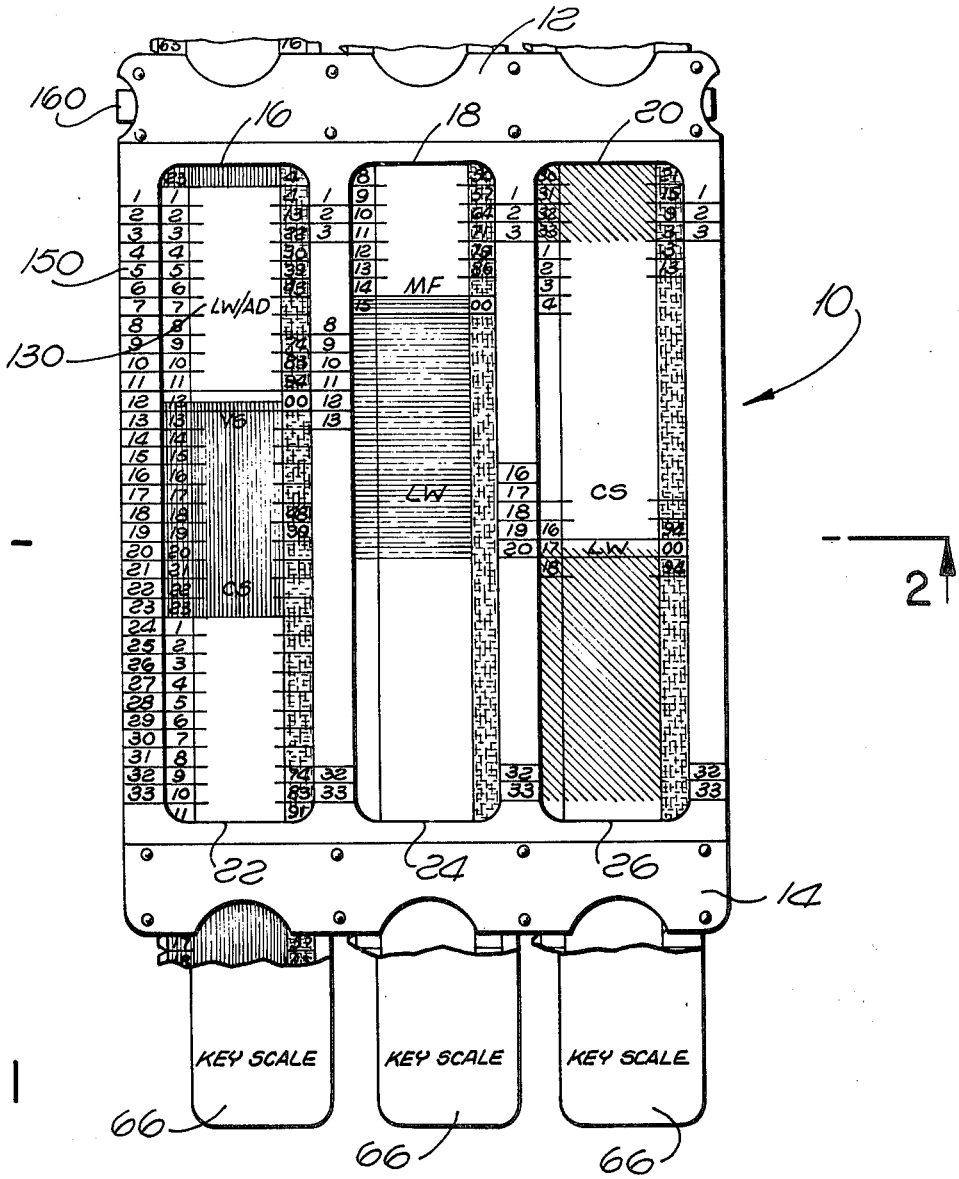
FIG. 1 is a plan view of the biorhythm calculator, in accordance with the invention with portions deleted to aid illustration.
Figure 2:
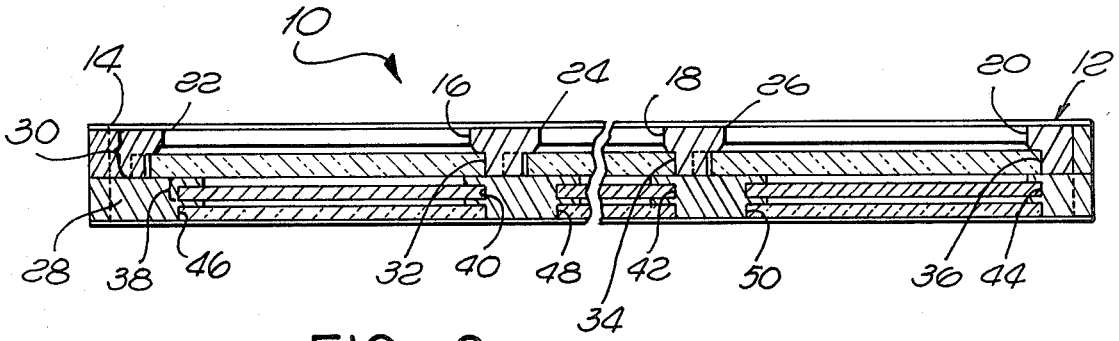
FIG. 2 is an enlarged sectional view with a portion broken away of the biorhythm calculator of FIG. 1 taken in the direction of Arrows 2—2 of FIG. 1.

Turning first to FIGS. 1 and 2, the biorhythm calculator of the present invention is shown generally indicated at 10. A housing 12 is provided to support and display various sliding scale members. It is preferably made of a non-warping, smooth, hard, material such as plastic, wood, or metal. The housing 12 is basically rectangular in shape and has an upper major surface 14. Housing 12 is provided with three parallel longitudinal channels, 16, 18, 20. Each of said channels has an open end, 22, 24, and 26 respectively at the major surface 14. Channels 16, 18 and 20 are spaced from each other by the frame 28 of the housing 12. Channels 16, 18 and 20 are preferably identical, with each having an upper portion 30, terminating in slots 32, 34, and 36 respectively, and a lower portion 38 of lesser thickness than the upper portion 30, with the lower portions 38 terminating in longitudinal slots 40, 42, and 44 respectively. As best seen in FIG. 2, upper slots 32, 34, and 36 and lower slots 40, 42, and 44 are parallel to major surface 14 and in approximate alignment with each other within respective channels 16, 18, and 20 and the respective upper ends 22, 24, and 26. Thus, an upper slot and a lower slot can be seen in each channel from the major surface 14 when unobstructed by other inserts. Optionally, additional longitudinal slots 46, 48, and 50 can be provided in housing 12 below the lower portions 38 of channels 16, 18, and 20.

Figure 4:
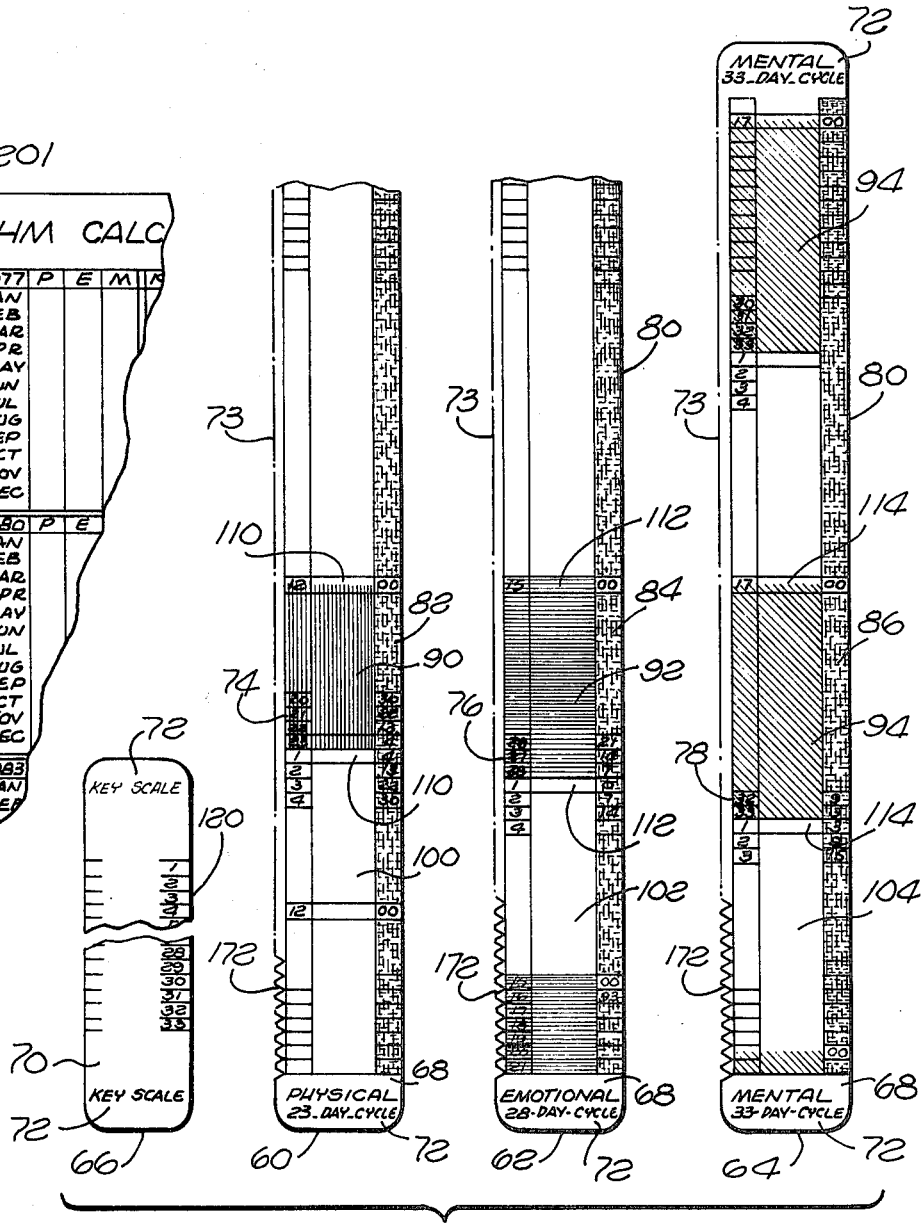
FIG. 4 is a plan view of the three rhythm scale members with portions of two of such members broken away and a plan view of a basic key scale member with portions broken away.

Referring now to FIG. 4, rhythm scale members 60, 62, and 64 and a basic key scale member 66 are illustrated. Rhythm scale member 60 corresponds to the physical or 23-day biorhythm cycle, rhythm scale member 62 corresponds to the emotional or 28-day biorhythm cycle, and rhythm scale member 64 corresponds to the mental or 33-day biorhythm cycle. Members 60, 62, 64, are in the form of thin rectangular strips preferably of a similar material to that of the housing 12. Each of the rhythm scale members has a major surface 68. Each of the members 60, 62, and 64 has labeling 72 at each end to indicate its nature.

Each of the rhythm scale members has its respective biorhythm cycle 74, 76, and 78 identified thereon. Each cycle is identified by the numbers of the days of the cycle, i.e., the physical biorhythm cycle 74 would be identified by the numbers 1 through 23 consecutively. These numbers of scales 74, 76, and 78 are positioned equally spaced along a longitudinal edge (the left-hand edge when positioned as shown in FIG. 4) of major surfaces 68. Depending upon the length of the longitudinal edge 73, the cycles 74, 76 and 78 may be repeated so as to occupy substantially all of the length of longitudinal edge 73. Equivalently, a graphical illustration of the cycle could be used.

On the opposite longitudinal edge 80, of major surfaces 68, is identified a compatibility scale. The compatibility scales 82, 84, and 86 respectively are identified by numbers which correspond to compatibility percentages. The numbers of scales 82, 84 and 86 are positioned on major surfaces 68 parallel to, in the same equal spacing, and in alignment with the numbers of scales 74, 76, and 78, respectively. Compatibility percentage is a measure of the percentage of days of a cycle which fall within the same period of that cycle for persons to be compared. Thus, if two people have the same rhythm scale number for any specific day, their compatibility will be 100% for that particular cycle, which is indicated by 00 on compatibility scales 82, 84, and 86. When two persons have a different rhythm scale number for any particular cycle, their compatibility will be less than 100% and is a function of where the two rhythm scale numbers are located in the biorhythm cycle relative to one another. With the present rhythm scale members, this is computed using 00 as the reference point. Thus, looking at the physical scale member 60, the numbers 23 and 1 of the cycle scale 74 are the furthest away from the reference point number 12 which corresponds to 00 on the compatibility scale 82. As such, the compatibility percentages for those two numbers are identical and is listed at 4% on compatibility scale 82. Further details as to biorhythm compatibility are described in the book entitled "Is This Your Day?" by George S. Thommen, Revised Edition, 1973.

To aid comparision with key scale members 66, rhythm scale members 60, 62, and 64 are made transparent. For indicating the different periods of the biorhythm cycles, different markings are provided for each cycle on major surfaces 68 between the respective rhythm scales and compatibility scales. For indicating low periods, a colored tint 90, 92, and 94 is provided in the respective areas adjacent to those numbers of the rhythm scales 74, 76 and 78 which correspond to low areas. Preferably this tint is color-coded to aid in identification of the different rhythm scale members. Thus, tint 90 is red, tint 92 is blue, and tint 94 is green. Additional color-coding can also preferably be provided by making the numbers of the rhythm scales 74, 76 and 78 and the respective labeling 72 the same color as tinted areas 90, 92 and 94. For indicating high periods, the areas 100, 102, and 104 adjacent to the numbers of rhythm scales 74, 76, and 78 would be clear rather than tinted. For indicating critical days, the areas 110, 112, and 114 adjacent to the numbers on rhythm scales, 74, 76 and 78 which correspond to critical days would be blocked off by parallel lines.

Preferably, the compatibility scales 82, 84 and 86 would also be color-coded to distinguish it from the corresponding rhythm scales. As such each compatibility scale would be of a yellow tint (except for the 00 area which would be of a white tint) with black numbers.

The basic key scale 66 is also a thin longitudinal strip. It is optimally opaque so that major surface 70 can most advantageously be viewed underneath the transparent rhythm scale members. On its major surface 70 are calibrated 33 graduations along both longitudinal edges and labeling 72 at each end. These graduations comprise the key scale 120. The numbers corresponding to the 33 graduations or units of key scale 120 are labeled along the right longitudinal side of major surface 70 as seen in FIG. 4. The graduations of key scale 120 have the same equal longitudinal spacing as the rhythm scales and compatibility scales of members 60, 62, and 64.

Member 66 is referred to as a basic key scale member in that it is devised as shown in FIG. 1 to add the initials of persons corresponding to the respective graduations, intermediate to the longitudinal sides and adjacent to corresponding numbers of key scale 120. Preferably, a label having the initials of the persons is applied to the intermediate area so that when different persons are to be used a new label could replace the old one after removing the old label.

There are normally three key scales 66, one corresponding to each of the different rhythm scale members 60, 62, and 64. Optimally, each key scale would be color-coded in the same color as its corresponding rhythm scale member. For example, the key scale 66 corresponding to the physical rhythm scale member 60 would have a red color-coding as by the labeling 72 and the numbers of scale 120 being red.

The numbers of key scale 120 correspond to figures indicating biorhythm positional relationship applicable to the corresponding biorhythm cycle. It should be noted that there are preferably 33 graduations on the key scale 120, however, the key scale 120 corresponding to the physical rhythm scale 74 would need only have 23 graduations and the key scale 20 corresponding to the emotional rhythm scale 76 would need have only 28 graduations. 33 graduations are used because that is the length of the mental cycle, which is the maximum number of possible biorhythm figures for any given cycle, the number of biorhythm figures corresponding to the number of days in the cycle, and so is used as a matter of uniformity.

Figures indicating biorhythm positional relationship can be determined in a number of ways. In one approach, based upon each person's biorhythm cycles being fixed relative to each other person's, a desired date can be selected as a reference birthdate. A table using the biorhythm history and future of that date would be used to calculate the desired figures. The position of the three biorhythm cycles for the reference for any given date would be subtracted from the number of days in each cycle plus one. The resulting numbers would be assigned that day. Thus, if the biorhythm figures for the reference are 2 for the physical cycle, 15 for emotional cycle, and 29 for the mental cycle, the assigned numbers for that day are 22, 14, and 5 respectfully, which is the fixed positional difference from the reference. Any person who has that day for a birthday would have those biorhythm positional figures. Thus, the figures corresponding to biorhythm positional relationship for any given person would be determined by looking up the birthday for that person on the table.

Another approach is to use basic biorhythm numbers for the figures indicating biorhythm positional relationship. The determination of the basic biorhythm figures for any given individual is disclosed in the aforementioned book by George Thommen on Pages 143 to 146 with tables used for the calculations listed on Pages 147 -152. In essence, one refers to a Table A for the month and day of his birth and reads corresponding figures for each of the three rhythm cycles. The person then refers to Table B and reads off the figures for each of the three cycles for the year of his birth and then adds the figures from Table B to the corresponding figures from Table A. If any of the resulting numbers is greater than the number of days in the respective cycle, the days of the cycle would be subtracted therefrom.

Referring to FIGS. 1 and 4, designations 130 of each person to be considered are placed intermediate the longitudinal key scale 120 adjacent the corresponding number (biorhythm positional relationship figure) of key scale 120 for each of the three key scale members 66. For example, a person's initials would be marked on each key scale member adjacent to the number corresponding to the biorhythm positional relationship figure for each respective cycle for that person. Thus, a person with the initials LW has those initials marked on the physical key scale member adjacent to the number 1, on the emotional key scale member adjacent to number 17, and on the mental key scale member adjacent to number 24.

Looking now to FIGS. 1 and 2, the placement of the rhythm scale members 60, 62, and 64 and key scale members 66 are illustrated. The rhythm scale members are located in upper slots 32, 34 and 36, preferably with the physical rhythm scale member 60 located in slot 32, the emotional rhythm scale member 62 located in slot 34, and the mental rhythm scale member 64 located in slot 36. The rhythm scale members are positioned in their respective slots such that their major surfaces 68 face towards the major surface 14 of housing 12. In this manner the major surfaces 68 of each rhythm scale member and the respective rhythm scales and compatibility scales and period identification are visible through the open ends 22, 24 and 26 of cavities 16, 18 and 20. Key scale members 66 are positioned in lower slots 40, 42, and 44 in accordance with the location of the corresponding rhythm cycle scale. Thus, the key scale member corresponding to the physical cycle would be positioned in slot 40, the key scale member corresponding to the emotional cycle would be positioned in slot 42, and the key scale member corresponding to the mental cycle would be positioned in slot 44. Key scales 66 would also be positioned with their major surfaces 70 facing upward toward the major surface 14 of housing 12. By virtue of the rhythm scale members being transparent, and the key scale members being in alignment with the rhythm scale members, the major surfaces 70 of the key scale members would be substantially visible through the respective rhythm scale members from the open ends 22, 24 and 26. Thus, depending where the rhythm scale members are longitudinally positioned, relative to the key scale members, the name designations 130 can be viewed through the rhythm scale members to see which period of the respective cycles is over which designations 130 and, therefore, corresponds to such designations 130.

As is clearly seen in FIG. 1, the length of rhythm scale members 60, 62, and 64 and key scale members 66 are greater than the length of housing 12. As such, the ends of the rhythm scale members and key scale members protrude outwardly from housing 12 and their respective slots, these slots running through the entire length of housing 12. As such, the rhythm scale members and key scale members can be manipulated by hand by sliding each within its slots to orient each member in a desired position.

Housing 12 is optimally provided with a reference scale 150 which is in essence the same as the key scale 120 on members 66. Reference scale 150 is identified along each longitudinal edge of open ends 22, 24 and 26 on the major surface 14 of housing 12. It comprises 33 equally spaced numbered graduations. These graduations have the same longitudinal spacing as the rhythm scales and compatibility scales of rhythm scale members 60, 62 and 64 and the key scale 120 of key scale members 66. Depending upon how the biorhythm calculator is used, reference scale 150 can correspond to either the days of a month or biorhythm figures for another type of calculation. Extra basic key scale members 66 can be located in slots 46, 48 and 50.

Figure 3:
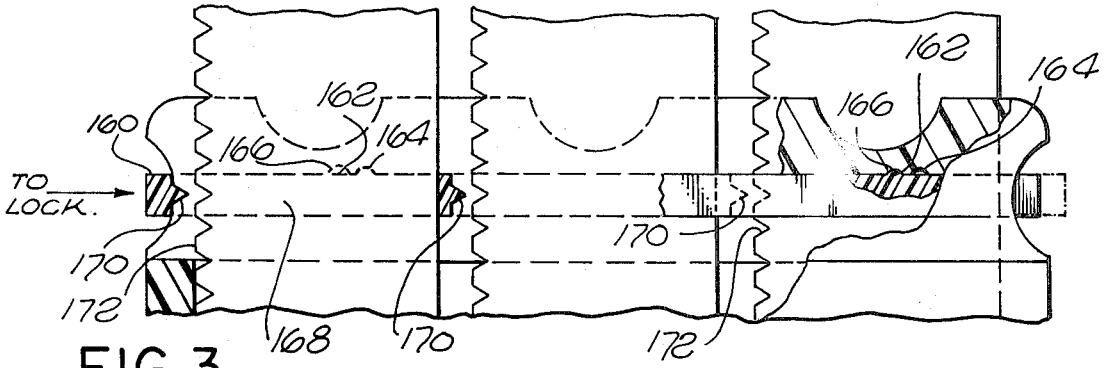
FIG. 3 is a detail view of the locking mechanism employed in the present invention.

Referring now to FIG. 3, there is shown a locking mechanism which can be provided with the present biorhythm calculator 10. The crux of the locking mechanism is a rectangular locking strip 160 which is movable within a lateral slot (not shown) in housing 12. The locking strip 160 protrudes out both of the longitudinal sides of housing 12 and is slidable within the lateral slot. The locking strip 160 is provided with a pair of spaced protuberances 162 along one longitudinal edge of the locking strip 160. These proturbances are designed to interact with 4 notches, two notches 164 being used for locking position, and two notches 166 being used for unlocked position. The notches 164 and 166 are provided within structure 28 of housing 12 in engaging alignment with protuberance 162. Locking strip 160 has a major surface 168 which faces upward towards major surface 14 of housing 12. On major surface 168 are provided three detents 170 which are designed to interact with notches 172 (see also FIG. 4) along one longitudinal edge of each of rhythm scale members 60, 62 and 64. Thus, in the unlocked position, locking strip 160 would be positioned as shown by the solid lines outside of housing 12, such that protuberances 162 would be in notches 166 and detents 170 would not interfere with notches 172 of the rhythm scale members and accordingly, not interfere with their movement. For locking, the locking strip 160 would be slid to the right as shown in FIG. 3 by the broken lines outside the housing 12 such that protuberances 162 would be forced from notches 166 and would then fall into notches 164 while simultaneously detents 170 would mesh within notches 172 of the rhythm scale members thereby restraining their movement and retaining their position. This facilitates positioning of the key scale members to correspond with their respective rhythm scale members.

OPERATION

Figure 5:
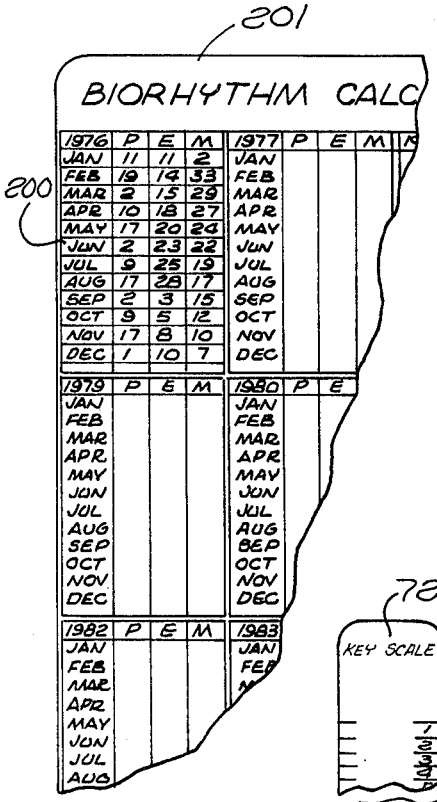
FIG. 5 is a bottom plan view of the biorhythm calculator of FIG. 1 with portions broken away illustrating a biorhythm chart which may be identified thereon.

The present biorhythm calculator is very flexible in that it allows for three types of calculations. The first step is to position all desired individuals on to the key scale. In essence, one refers to the aforementioned table for the birthdays of the desired persons and reads the corresponding figures for each of the three rhythm cycles. Alternatively, basic biorhythm figures could be used. Thus, referring to FIG. 1, designation 130 of each person to be considered are placed intermediate the longitudinal key scale 120 adjacent the corresponding number of key scale 120 for each of the three key scale members 66. For the first type of calculation, the user of the biorhythm calculator 10 would first consult a chart 200 such as that which may be illustrated on the rear major surface 201 of the calculator 10 as shown in FIG. 5. This chart gives the biorhythm figures for the first day of the listed months for the reference birthday. Those figures would then be used to orient the respective rhythm scale members with regard to the reference scale 150. For example, if Mar. 1, 1976, is desired, the physical rhythm scale member 60 would be aligned such that number 2 of rhythm scale 74 would correspond to number 1 of reference scale 150, emotional scale member 62 would be aligned such that number 15 of emotional scale 76 would correspond to number 1 on reference scale 150, and mental rhythm scale member 64 would be aligned such that number 29 of mental scale 78 would correspond to number 1 of reference scale 150. Key scale numbers 66 would be in exact alignment with reference scale 150, i.e., 1 corresponding with 1, 2 corresponding with 2, and so on. The user could then look through the different open ends and see what periods of the cycles, such as the high period 90 for physical rhythm scale number 60 are applicable to the various designations 130. Thus, the user is able to determine which individuals are having low periods 90, 92, 94, high periods 100, 102, 104, and critical periods 110, 112, 114, in each of the three scales simultaneously without resetting. Should a midmonth be desired, such as Mar. 15, 1976, all that is required is to set the calculator as you have done for the first day of the month. Then using the reference scale 150 to represent the days of the month, the numbers that are aligned with the desired date, in this case #15, in each of the three rhythm scale members 74, 76, 78, are to be realigned so they would correspond to number one of reference scale 150. Thus, for Mar. 15, 1976, the figures in the chart would then be 16 for the physical cycle, 1 for the emotional cycle, and 10 for the mental cycle.

Compatibility for each of the different cycles is determined by moving the respective rhythm scale member to where 00 of the compatibility scale for that rhythm scale member corresponds to a designation 130 for the person to be compared. Then, all other designations 130 on the key scale number 66 corresponding to the rhythm scale member used can be compared to the compatibility scale as positioned. The corresponding compatibility scale number for each designation is the compatibility percentage for that designated person to the original person to be compared who corresponds to 00 as positioned.

It is also possible to calculate for any of the persons designated on the respective key scales their biorhythm for an entire month as seen through the open ends of housing 12. For this calculation one would first go through the first calculation. Assuming Mar. 1, 1976, is used again what is indicated after the first calculation is the biorhythm for each designated person as of that date. In order to view the whole month for the desired person, the designation corresponding to that person on each key scale number 66 would be slid to correspond with number 1 of reference scale 150. In this position, the numbers of reference scale 150 would correspond to the days of the desired month for the designated person and by comparing such numbers of reference scale 150 to the periods indicated on the rhythm scale members, the biorhythm for each of the cycles for the entire month is illustrated.

While one advantageous embodiment has been chosen to illustrate the invention, it will be understood by those skilled in the art that various changes and modifications can be made therein without departing from the scope of the invention as defined in the claims.

What is claimed is:

1. A biorhythm calculator comprising:

a rhythm scale member having a major surface, said surface having a biorhythm cycle identified thereon, said cycle being identified by numbers of the days of said cycle, said numbers being divided into three identified groups corresponding to high, low, and critical periods of said cycle; and a key scale member having a major surface parallel to the major surface of said rhythm scale member, said major surface of said key scale member being calibrated to identify figures indicating biorhythm positional relationship for said biorhythm cycle, said rhythm scale member and said key scale member being movable relative to one another whereby said figures can be compared to said identified groups to indicate said periods of said cycle corresponding to said figures.

2. A calculator as set out in claim 1, wherein there are three rhythm scale members, a first rhythm scale member identifying the numbers of the days of a physical biorhythm cycle, a second rhythm scale member identifying the number of days of an emotional biorhythm cycle, and a third rhythm scale member identifying the numbers of days of the intellectual biorhythm cycle, said rhythm scale members being positioned alongside one another and at least three key scale members, the first key scale member identifying said figures for said physical biorhythm cycle, a second key scale member identifying said figures for said emotional biorhythm cycle, and a third key scale member identifying said figures for said intellectual biorhythm cycle, said key scale members corresponding respectively to said rhythm scale members.

3. A calculator as set out in claim 2, also including a housing means for supporting said rhythm scale members and said key scale members, said rhythm scale members and said key scale members being longitudinally slidable within said housing.

4. A calculator as set out in claim 3 wherein said rhythm scale members and said key scale members are rectangular strips, and numbers of the days of the respective cycles are positioned equally spaced on said major surface of said rhythm scale members along a longitudinal edge thereof.

5. A calculator as set out in claim 4 wherein said rhythm scale members have a compatibility scale thereon, said compatibility scale being identified by numbers corresponding to compatibility percentages, said numbers corresponding to compatibility percentages being the percentage of compatibility between each day in the cycle to a reference day in the cycle, said numbers corresponding to compatibility percentages being positioned on said major surface of said rhythm scale members parallel to, in the same equal spacing as, and in alignment with said numbers of the days of said respective cycles.

6. A calculator as set out in claim 3 also including locking means for retaining the position of said rhythm scale members within said housing means.

7. A calculator as set out in claim 5 wherein said rhythm scale members are transparent, said key scale members are opaque, said housing means is rectangular, said housing means having at least six parallel longitudinal slots, three of said slots being upper slots, and three of said slots being lower slots, each of said upper slots being positioned above and in alignment with one of said lower slots, said rhythm scale members being located in said upper slots, and said key scale members being located in said lower slots in a manner that each of said key scale members are aligning with the corresponding rhythm scale member.

8. A calculator as set out in claim 7 wherein said housing means has at least three parallel spaced longitudinal channels, said housing means has a major surface, each of said channels has an open end at said major surface of said housing means, each of said channels having one of said upper slots and the lower slot aligning with said upper slot located therein, said slots in said channels being parallel to said major surface of said housing means, said key scale members and said rhythm scale members being positioned in said slots such that their respective major surfaces are facing said open ends and are parallel to said major surface of said housing means, whereby said rhythm scale members and said key scale members are visible from outside said housing means.

9. A calculator as set out in claim 8 wherein said key scale members have designations for persons corresponding to at least a portion of said figures identified on said major surface of said key scale members adjacent corresponding figures, said housing means has identified reference scale numbers located adjacent to each longitudinal side of said open ends in the same equal spacing as the days of the respective cycles, said reference scale numbers representing the days of a month for one type of calculation.

10. A method for simultaneously determining periods of a biorhythm cycle for a plurality of persons for a specific day comprising the steps of:

providing a biorhythm calculator, said calculator having a rhythm scale member, said rhythm scale member having a major surface, said surface having a biorhythm cycle identified thereon, said cycle being identified by numbers of the days of said cycle, said numbers being divided into at least three identified groups corresponding to high, low, and critical periods of said cycle, and a key scale member having a major surface parallel to the major surface of said rhythm scale member, said surface of said key scale member being calibrated to identify figures indicating biorhythm positional relationship for the biorhythm cycle, said key scale member having designations for a plurality of persons corresponding to at least a portion of said figures identified on said major surface of said key scale member, each of said designations being adjacent corresponding figures, said members being movable relative to one another;

orienting said numbers of the days of said cycle to said figures by moving said members relative to one another as a function of the specific day to be considered; and comparing said groups to said designations to determine the periods of said cycle applicable to the plurality of persons for the specific day.

11. A biorhythm calculator comprising:

a rhythm scale member having a major surface, said surface having a compatibility scale thereon, said compatibility scale being identified by numbers corresponding to compatibility percentages, said numbers corresponding to compatibility percentages being the percentage of compatibility between each day of a particular biorhythm cycle to a reference day in said cycle; and a key scale member having a major surface parallel to the major surface of said rhythm scale member, said major surface of said key scale member being calibrated to identify figures indicating biorhythm positional relationship for said biorhythm cycle, said rhythm scale member and said key scale member being movable relative to one another whereby said figures can be compared to said compatibility scale to indicate compatibility between said figures.

* * * * *